United States Patent [19]

Smerz

[11] Patent Number: 4,564,257

[45] Date of Patent: Jan. 14, 1986

[54] LAMP ADAPTER FOR SCREW TERMINAL LAMPS

[75] Inventor: Frank G. Smerz, Addison, Ill.

[73] Assignee: Cooper Industries, Houston, Tex.

[21] Appl. No.: 478,707

[22] Filed: Mar. 25, 1983

[51] Int. Cl.[4] ..... H01R 33/74

[52] U.S. Cl. ..... 339/145 R; 339/146; 339/154 L; 339/167; 339/263 R

[58] Field of Search ..... 339/263 R, 154 L, 154 A, 339/155 L, 160, 167, 168, 277 R, 272 UC, 145 R, 146

[56] References Cited

U.S. PATENT DOCUMENTS

| | | | |
|---|---|---|---|
| 1,379,244 | 5/1921 | Benjamin et al. | 339/154 L |
| 1,665,987 | 4/1928 | Smith | 339/154 L |
| 1,823,049 | 9/1931 | Kenerson | 339/154 L |
| 1,982,781 | 12/1934 | Benjamin | 339/154 L |
| 2,272,512 | 2/1942 | Cotman et al. | 339/263 R |
| 2,648,054 | 8/1953 | Berg | 339/277 R |
| 2,880,380 | 3/1959 | Schmidt et al. | 339/272 UC |
| 3,137,448 | 6/1964 | Holzhause | 339/154 A |
| 3,816,820 | 6/1974 | Stanaitis | 339/277 R |
| 4,360,243 | 11/1982 | Johnson et al. | 339/154 L |

*Primary Examiner*—Eugene F. Desmond
*Assistant Examiner*—David L. Pirlot
*Attorney, Agent, or Firm*—Eddie E. Scott; Alan R. Thiele

[57] ABSTRACT

An adapter for adapting an electric lamp of the type having two or more screw terminals to fit into a lamp socket includes a socket engaging base electrically connected to two or more resilient conductive support members that engage the screw terminals of the lamp and provide mechanical support and electrical contact for the lamp.

20 Claims, 7 Drawing Figures

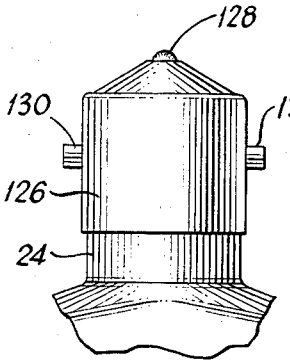
Fig. 7
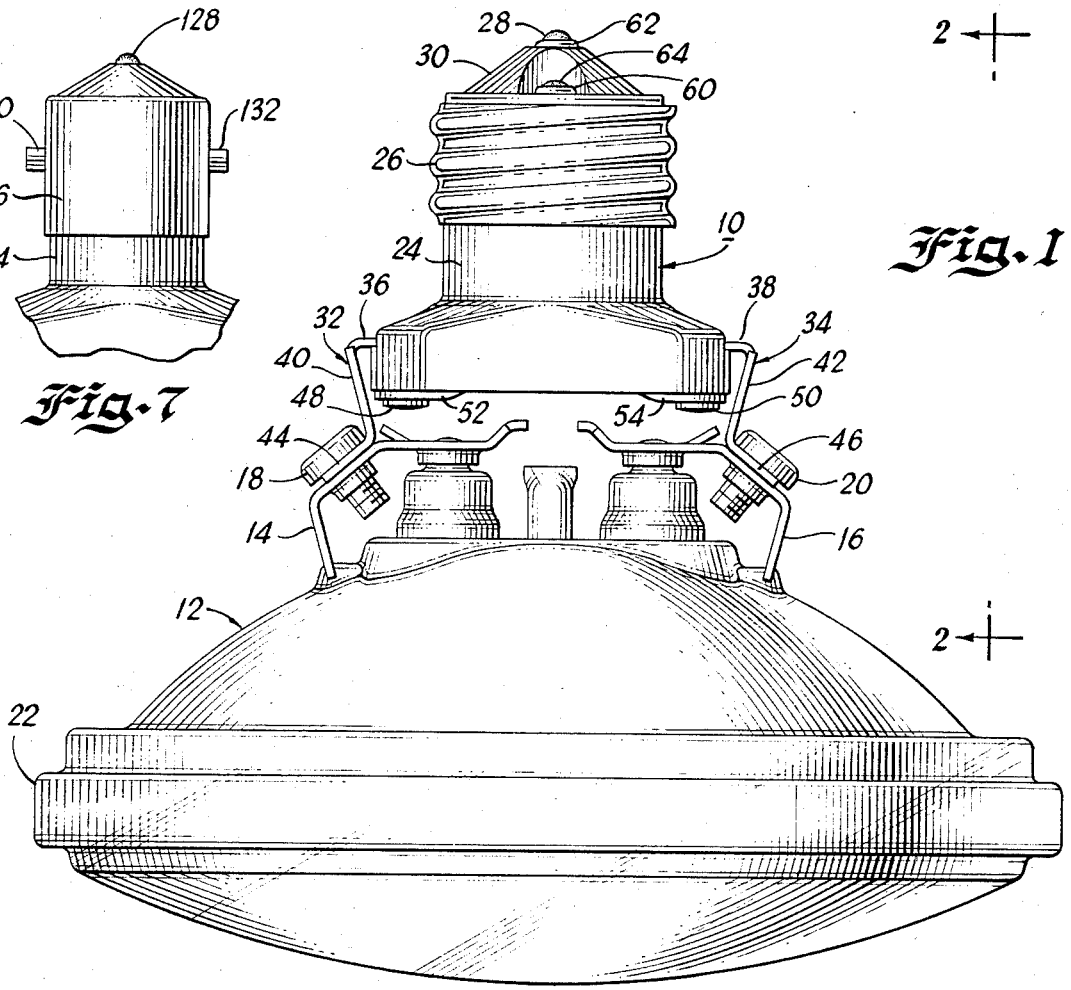
Fig. 1
Fig. 2
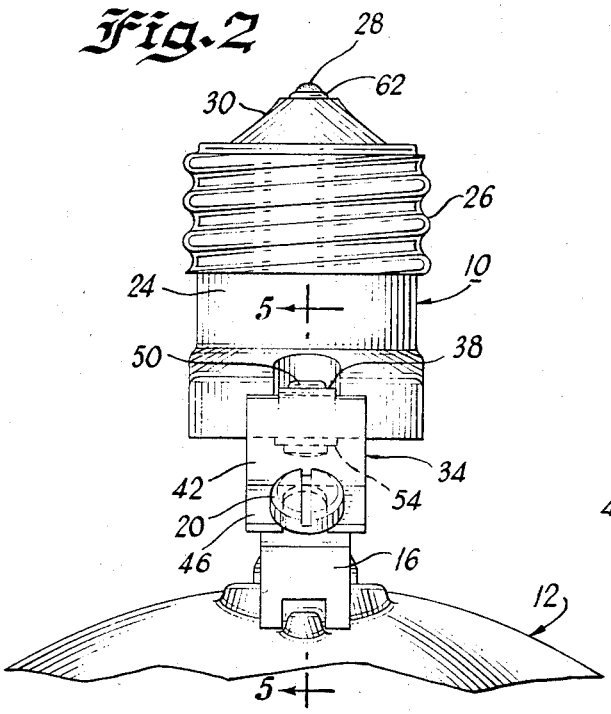
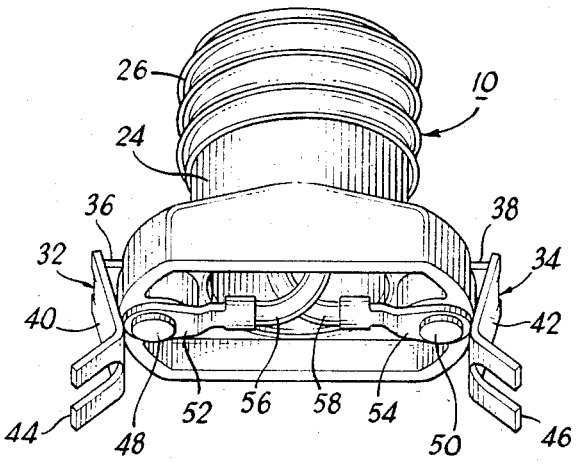
Fig. 3

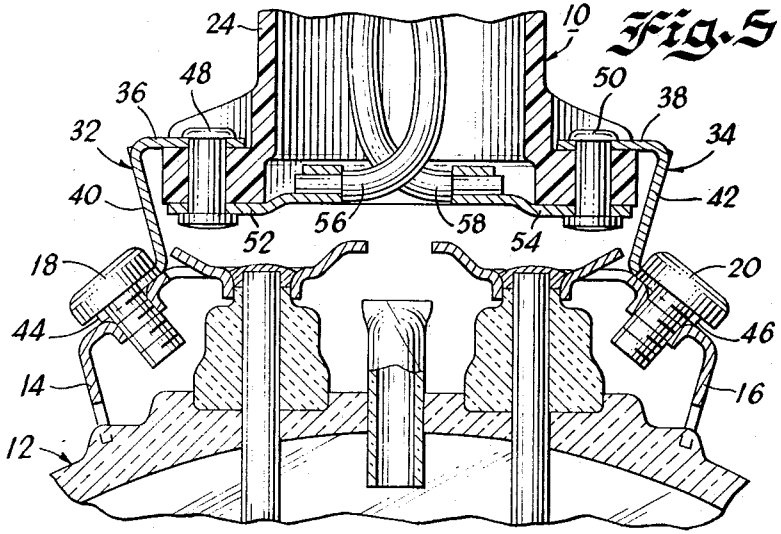
Fig. 5
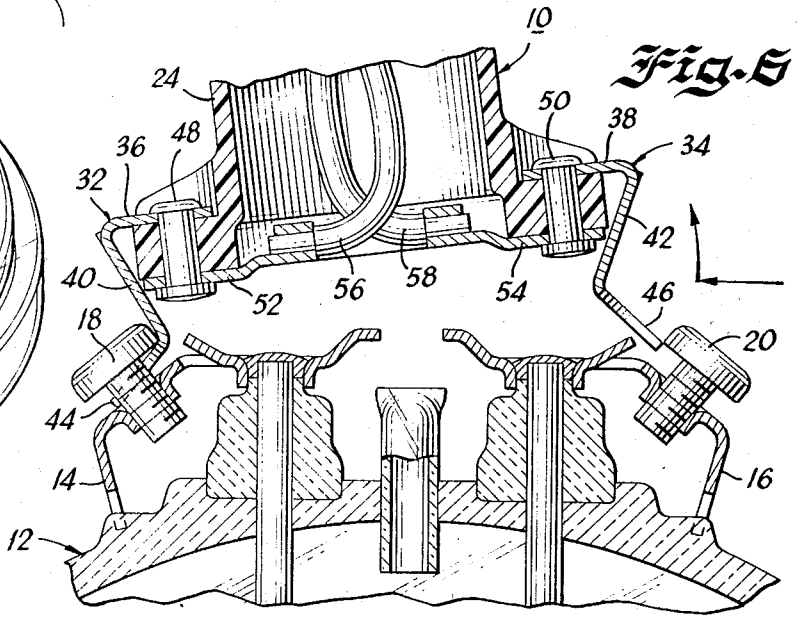
Fig. 6
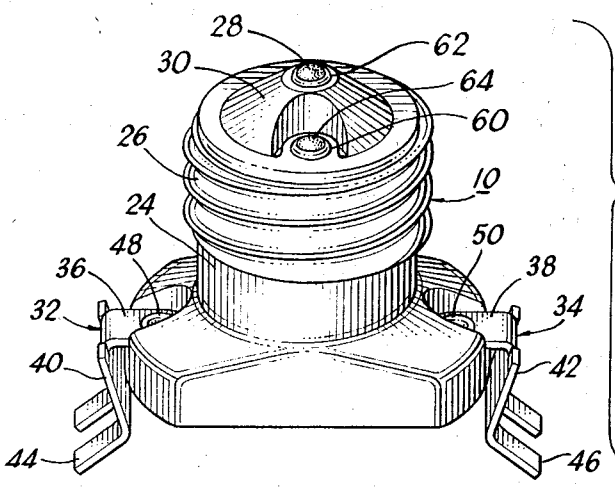
Fig. 4
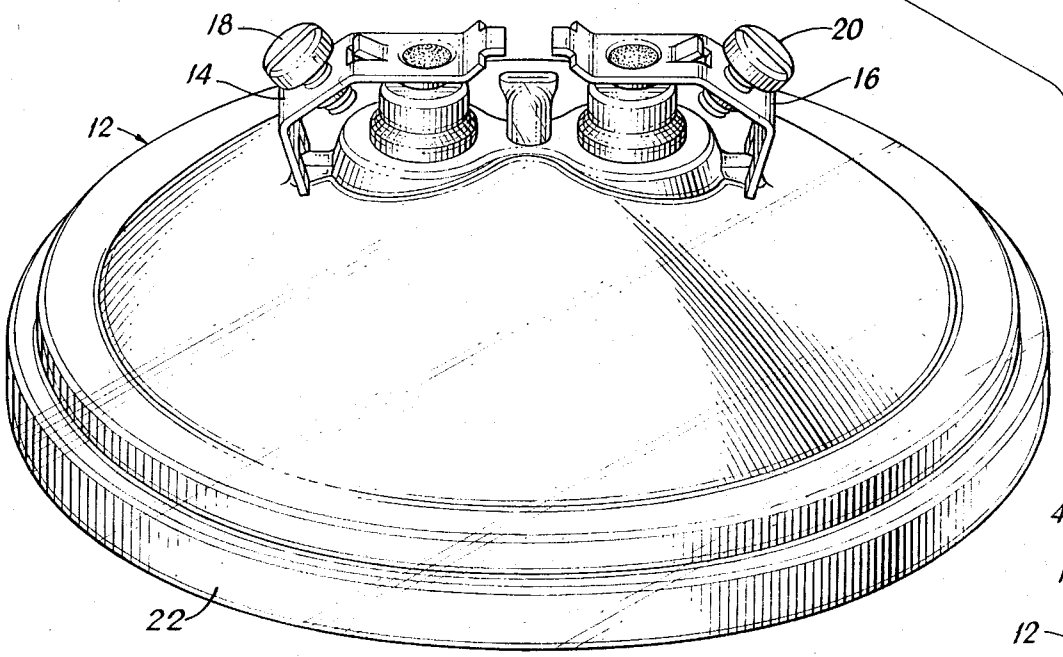

LAMP ADAPTER FOR SCREW TERMINAL LAMPS

BACKGROUND OF THE INVENTION

This invention relates generally to adapters and mounting devices for electric lamps. More particularly, this invention relates to an adapter for an electric lamp of the type having two screw terminals that serves to support the lamp and permit them to be used in conjunction with a screw-in or other type lamp socket.

Electric lamp adapters are known. Examples of lamp adapters are adapters that adapt one size screw base to another size screw base, such as, for example, an adapter that adapts a standard screw base to a mogul screw base socket or vice versa. In addition, adapters, or more precisely sockets that adapt a lamp having a base to a pair of screw terminals, are also known. Examples of other electric lamp adapters are illustrated in U.S. Pat. Nos. 2,394,468 and 3,746,906, which illustrate adapters for adapting non-standard lamp bases to bayonet or screw bases, respectively.

While the prior art adapters do provide a way to adapt one type of a lamp base to another, none of the prior art devices provide a way to adapt a lamp of the type having two screw terminals for use with a screw, bayonet or other type of lamp socket.

SUMMARY OF THE INVENTION

Accordingly, it is an object of the present invention to provide an adapter that overcomes many of the disadvantages of the prior art adapters.

It is another object of the present invention to provide an electric lamp adapter that adapts a lamp of the type having two or more screw terminals for use with a lamp socket.

It is another object of the present invention to provide an adapter that permits the use of a lamp of the type having two or more screw terminals with a screw type socket.

It is another object of the present invention to provide a lamp adapter that is readily removable from the lamp.

It is another object of the invention to provide an adapter that adapts a lamp of the type having two or more screw terminals for use with a socket and provides mechanical support for the lamp.

It is another object of the present invention to provide an adapter that permits the use of a lamp of the type having two screw terminals with a standard light fixture.

Briefly, in accordance with a preferred embodiment of the present invention, there is provided an adapter for adapting a lamp of the type having two or more screw terminals for use with a screw-in or other type of socket. The adapter has a body portion, preferably made of an insulating material, having a socket engaging base portion disposed on one end thereof. In addition, two or more screw terminal engaging members extend in a spaced relationship from the body portion and serve to engage the screw terminals of the lamp when the lamp is assembled thereto. Preferably, the screw terminal engaging members are fabricated from a resilient conductive material that provides both an electrical contact and mechanical supports for the lamp. When assembled, the lamp and adapter can be used in conjunction with a lamp socket by simply engaging the base portion and the lamp socket.

These and other objects and advantages of the present invention will readily be understood upon consideration of the following detailed description and attached drawings.

DESCRIPTION OF THE DRAWING

FIG. 1 is a front elevational view of the lamp adapter according to the present invention assembled to a lamp having two screw terminals;

FIG. 2 is a broken side elevational view of the adapter and lamp assembly taken along line 2—2 of FIG. 1;

FIG. 3 is a perspective of the adapter, as viewed from the underside, showing the configuration of the base and body portion, the screw terminal engaging members, and the electrical connections between the screw terminal engaging members and the base;

FIG. 4 is a perspective view of the adapter removed from the lamp showing the configuration of the lamp and the adapter in greater detail;

FIG. 5 is a broken sectional view of the lamp and adapter assembly taken along line 5—5 of FIG. 2;

FIG. 6 is a cross-sectional view similar to FIG. 5 showing how the adapter is installed on and removed from the lamp; and FIG. 7 is a front broken elevational view of an alternative embodiment of the invention showing an adapter having a bayonet base portion usable with a bayonet socket.

DETAILED DESCRIPTION OF THE PREFERRED EMBODIMENT

Referring now to the drawing, with particular attention to FIG. 1, there is illustrated a preferred embodiment of the adapter according to the invention generally designated by the reference numeral 10. The adapter 10 is attached to a lamp 12 having two screw terminals consisting of conductive metal terminal portions 14 and 16 which are electrically connected to the filament (not shown) of the lamp 12 and which threadably receive a pair of terminal screws 18 and 20. Various lamps having two screw terminals may be utilized as the lamp 12; however, the lamp illustrated in the drawing is a low voltage sealed beam reflector lamp of the type typically used in low voltage lighting systems and in emergency lighting systems.

One example of a lamp usable as the lamp 12 is a No. 7613 lamp manufactured by the General Electric Company and others. This lamp has a rating of 6 volts at 1.33 amperes, but similar lamps that operate at different voltages and different currents are also available. Typically, screw terminal lamps such as the lamp 12 are supported in a housing or the like (not shown) by a ring or plurality of retaining members (also not shown) that engage a rim 22 of the lamp 12. Electrical contact to lamp 12 is made by wires that engage the screws 18 and 20 and make electrical contact to the terminals 14 and 16.

However, in many instances it would be desirable to utilize the lamp 12 in conjunction with a socket, such as, for example, a standard screw base lamp socket such as the socket used in conjunction with a standard 110-volt incandescent lamp. Among the reasons that it may be desirable to adapt the lamp 12 for use with a standard socket is that an existing installation may already have such sockets, the housing and supporting structure normally used with a screw terminal lamp may be unavailable or more costly than a standard socket, or the lamp may be utilized in an application where frequent and easy replacement is required. In the last mentioned situation, a screw base socket is particularly advantageous because it provides support for the lamp and permits ready replacement of the lamp without removing any lamp supporting structure.

Therefore, in order to permit the lamp 12 to be used in conjunction with a standard screw base socket (not shown), adapter 10 is provided with a body portion 24, preferably made from an insulating material such as phenolic or other plastic, or of a ceramic or glass material. A threaded portion 26, made from a conductive material, such as, for example, aluminum, copper or brass is affixed to a cylindrical end of the body portion 24 and serves to engage the threads of the socket and make electrical contact thereto. A central contact 28 is disposed at a conical end 30 of the body portion 24 so that threaded portion 26, central contact 28 and conical portion 30 provide a configuration similar to the configuration of the base of a standard 110-volt lamp.

In accordance with an important aspect of the present invention, the adapter 10 is provided with two screw terminal engaging members 32 and 34. However, it should be understood that, in the event that the lamp being utilized had more than two screw terminals, a screw engaging member would be provided for each screw terminal. Each of the members 32 and 34 is fabricated from a resilient conductive material such as phosphor bronze, beryllium copper or spring brass. Each of the members 32 and 34 includes a laterally extending member 36 and 38, a generally vertical portion 40 and 42, and a bifurcated screw terminal engaging end 44 and 46, respectively. The laterally extending portions 36 and 38 are affixed to the body portion 24 by a pair of conductive rivets 48 and 50 (best shown in FIG. 5) or by similar fasteners, such as, for example, eyelets, screws or the like. The rivets 48 and 50 serve to support members 32 and 34, and to make electrical contact between members 32 and 34 and a pair of connectors 52 and 54 (FIG. 3) that are attached to a pair of wires 56 and 58 that extend through a pair of eyelets 60 and 62. The wire extending through the eyelet 60 is soldered or eyeleted in place at joint 64 to provide an electrical contact between the threaded ring 26 and one of the members 32 and 34. The other wire is soldered or eyeleted in place which retains the wire within the eyelet 62 and simultaneously forms the central contact 28. Thus, the central contact 28 is electrically connected to the other one of the members 32 and 34.

Because of the resiliency of the members 32 and 34, the adapter 10 is readily attached to and removed from lamp 12. For example, removal of the adapter 10 from the lamp 12 is readily accomplished by moving the adapter 10 laterally to deflect the member 34, and by deflecting the member 34 to remove it from engagement with the screw 20. This motion is illustrated by the arrows in FIG. 6. Installation of the base 10 is accomplished in a similar manner by bringing one of the members 32 and 34 into engagement with one of the screws 18 and 20, deflecting members 32 and 34, bringing the other member into engagement with the other screw, and releasing the pressure on the resilient members. Once the pressure has been released, members 32 and 34 will return to their original position, as shown in FIG. 5. The screws 18 and 20 may then be tightened to securely attach the adapter 10 and the lamp 12 together.

The present invention has been described above for use in conjunction with a standard 110-volt screw type lamp socket because such sockets are very common. However, the present invention can be used in conjunction with various other lamp sockets. For example, the present invention may be used with other screw type sockets such as, for example, mogul or candelabra type sockets. These sockets are also screw type sockets except that mogul socket is larger than a standard 110-volt socket, and the candelabra socket is smaller.

In addition, the invention may be utilized in conjunction with sockets other than screw type sockets, for example, with a bayonet type socket typically found in automobiles and electronic equipment. In such an application, the base portion of the body 24 would utilize an unthreaded socket engaging sleeve 126 in place of the threaded portion 26, as shown in FIG. 7. A pair of socket engaging protrusions 130 and 132 would extend from the sleeve 126, and one or more central contacts 128 similar to the central contact 28 would be employed. The protrusions 126 and 130, as well as the central contact 128, would be disposed relative to each other in a manner to provide a base similar to the base of a bayonet base lamp. More than one contact 128 would be provided if they were to be used with a multifilament lamp.

Obviously, many modifications and variations of the present invention are possible in light of the above teachings. Thus, it is to be understood that, within the scope of the appended claims, the invention may be practiced otherwise than as specifically described above.

I claim:

1. An adapter for adapting an electric lamp of the type having screw terminals to fit into a lamp socket comprising:

a body portion;

socket engaging base extending from said body portion; and means including at least two screw terminal engaging members affixed to said body portion in a predetermined spaced apart relationship for engaging said screw terminals to affix and rigidly support said lamp to said body portion.

2. An adapter as recited in claim 1 wherein each of said screw terminal engaging members has a bifurcated end.

3. An adapter as recited in claim 2 wherein said screw terminal engaging members are fabricated from a resilient conductive material.

4. An adapter as recited in claim 3 wherein said material is phosphor bronze.

5. An adapter as recited in claim 3 wherein said material is beryllium cooper.

6. An adapter as recited in claim 3 wherein said material is spring brass.

7. An adapter as recited in claim 3 wherein each of said screw terminal engaging members includes a portion that extends laterally from said body portion, a downwardly extending portion, and wherein said bifurcated end extends diagonally from said downwardly extending portion.

8. An adapter as recited in claim 3 wherein said body portion is fabricated from an insulating material.

9. An adapter as recited in claim 8 wherein said insulating material is phenolic.

10. An adapter as recited in claim 9 wherein said body portion is hollow.

11. An adapter as recited in claim 3 wherein said base comprises a sleeve and central contact disposed on said body portion.

12. An adapter as recited in claim 11 wherein said sleeve is externally threaded.

13. An adapter as recited in claim 11 wherein said sleeve has two socket engaging protrusions extending therefrom.

14. An adapter as recited in claim 11 wherein said sleeve is electrically connected to one of said screw terminal engaging members and said central contact is connected to the other one of said screw terminal engaging members.

15. An adapter as recited in claim 14 further including a pair of wires, one of said wires being connected between one of said screw terminal engaging members and said central contact and the other one of said wires being connected between a second of said screw terminal engaging members and said sleeve.

16. An adapter as recited in claim 15 further including at least two eyelets, one of said eyelets being connected to each of said wires, said adapter further including at least two rivets, each of said rivets extending through one of said screw terminal engaging members, said body portion and one of said eyelets to thereby provide support for said screw terminal engaging members and electrical contact between said terminal screw engaging members and said wires.

17. An adapter for adapting a lamp having two screw terminals to fit into a lamp socket comprising:

a body portion;

a socket engaging base extending from said body portion; and means for rigidly supporting said lamp in a predetermined relationship with respect to said body portion, said supporting means including a pair of electrically conductive supporting members electrically coupled to a pair of electrical terminals associated with said base and being affixed to and extending from said body portion in a predetermined spaced apart relationship, said supporting members each having means for engaging said screw terminals and a predetermined configuration providing for engagement of said means for engaging to said screw terminals for rigidly affixing and supporting said lamp to said body and providing electrical contact thereto.

18. An adapter as recited in claim 17 wherein said screw terminal engaging means includes a bifurcated end extending from each of said supporting members.

19. An adapter as recited in claim 17 wherein said supporting members are fabricated from a resilient material to permit the supporting members to be deflected with respect to each other to permit said means for engaging to be readily engaged and disengaged from said screw terminals providing for the adapter to be readily attached to and removed from the lamp.

20. An adapter for adapting an electric lamp of the type having a pair of screw terminals to fit into a lamp socket comprising:

a body portion made of electrically insulating material;

a socket engaging base portion extending from said body portion;

a first central electrical contact on said base portion adapted to engage an electrical terminal in said socket;

a second electrical contact in the form of a sleeve around said base portion adapted to be received in sid socket; and means for attaching said lamp to said body portion including a first member attached at one end thereof to said body portion and including first means for engaging said screw terminals, a second member attached at one end thereof to said body at a location substantially opposite to said first member, and including second means for engaging said screw terminals, said first and second members configured to rigidly attach said lamp to said body when both of said first and said second means for engaging said screw terminals are affixed to said screw terminals and to provide for resilient, lateral motion of at least one of said first and second members relative to said body portion when either one of said first and second means for engaging said screw terminal is loose on said screw terminal.

* * * * *